US011896100B2

(12) United States Patent
Small et al.

(10) Patent No.: US 11,896,100 B2
(45) **Date of Patent: *Feb. 13, 2024**

(54) APPARATUS WITH SELF-RETRACTING ELASTOMERIC SUPPORT BAND

(71) Applicant: SLINGER, LLC, Preston, TX (US)

(72) Inventors: Mark Small, Fort Smith, OK (US); Steven E. Shaw, Prosper, TX (US); Eric Montalvo, Washington, DC (US)

(73) Assignee: SLINGER, LLC, Prosper, TX (US)

( * ) Notice: Subject to any disclaimer, the term of this patent is extended or adjusted under 35 U.S.C. 154(b) by 49 days.

This patent is subject to a terminal disclaimer.

(21) Appl. No.: 17/826,047

(22) Filed: May 26, 2022

(65) Prior Publication Data

US 2022/0312920 A1 Oct. 6, 2022

Related U.S. Application Data

(63) Continuation-in-part of application No. 17/116,156, filed on Dec. 9, 2020, now Pat. No. 11,388,979.

(51) Int. Cl.

| | |
|---|---|
| ***A45F 5/00*** | (2006.01) |
| ***A45C 11/18*** | (2006.01) |
| *A45C 11/00* | (2006.01) |

(52) U.S. Cl.

CPC ..... *A45C 11/182* (2013.01); *A45F 5/004* (2013.01); *A45C 2011/002* (2013.01); *A45C 2200/15* (2013.01); *A45F 2005/006* (2013.01); *A45F 2200/0516* (2013.01)

(58) Field of Classification Search

CPC ..... A45F 5/004; A45F 2005/006; A45F 2200/0508; A45F 2200/0516; A45F 2200/0525; A45F 2003/142; A45C 11/00; A45C 2011/002; A45C 13/30; A45C 13/26; A45C 2011/001; F16M 13/00; Y10S 224/93; B65H 75/368; B65H 75/4428

USPC ..... 224/162; 361/679.59

See application file for complete search history.

(56) References Cited

U.S. PATENT DOCUMENTS

| | | | | |
|---|---|---|---|---|
| 5,331,721 | A * | 7/1994 | Raum, Sr. | A45F 5/021 24/3.12 |
| 5,794,881 | A | 8/1998 | Evans | |
| 5,881,932 | A * | 3/1999 | Wadden | A45F 3/04 150/108 |
| 6,145,169 | A * | 11/2000 | Terzuola | A44B 11/005 24/191 |
| 6,874,722 | B2 | 4/2005 | Wei | |
| 7,270,329 | B2 * | 9/2007 | Barthold | A63F 9/18 273/276 |

(Continued)

*Primary Examiner* — Adam J Waggenspack

(74) *Attorney, Agent, or Firm* — Stamoulis & Weinblatt, LLC

(57) ABSTRACT

Apparatus selectively attachable to the outer case of a cellular telephone or other similarly sized portable device. The apparatus desirably includes a housing containing an elastomeric band that is principally disposed inside the housing when the apparatus is not in use. The apparatus may include a kickstand and a cardholder. The elastomeric band can be used as a selectively retractable carrying strap when the cell phone or other similar device is not in use. Alternatively, the flexible continuous loop can be used, for example, to support the cell phone around a user's neck for hands-free use when the user is engaged in other activities.

24 Claims, 14 Drawing Sheets

(56) References Cited

U.S. PATENT DOCUMENTS

| | | | | |
|---|---|---|---|---|
| 7,604,142 | B2 * | 10/2009 | Banik | A45D 40/221 220/829 |
| 8,408,513 | B2 | 4/2013 | Smith | |
| 8,915,409 | B2 * | 12/2014 | Smith | B65H 75/4428 224/258 |
| 9,274,550 | B2 * | 3/2016 | Mau | E05D 11/087 |
| 10,143,295 | B2 | 12/2018 | Palma | |
| 10,171,639 | B2 * | 1/2019 | Hu | H04M 1/04 |
| 10,344,512 | B2 * | 7/2019 | Bertani | E05D 11/1064 |
| 10,631,402 | B2 * | 4/2020 | Xiang | G09F 9/301 |
| 11,026,502 | B1 | 6/2021 | Erold | |
| 11,147,360 | B2 * | 10/2021 | Michael | A45F 5/021 |
| 11,371,649 | B2 * | 6/2022 | Shannon | F16M 13/005 |
| 2003/0089832 | A1 * | 5/2003 | Gold | G06F 1/1632 248/454 |
| 2008/0035778 | A1 * | 2/2008 | Belden | B65H 75/446 242/375 |
| 2010/0206922 | A1 | 8/2010 | Gross et al. | |
| 2014/0198442 | A1 * | 7/2014 | Rekuc | A45C 13/30 190/115 |
| 2015/0342324 | A1 * | 12/2015 | Zhao | A45F 3/02 224/153 |
| 2016/0094262 | A1 | 3/2016 | Chorny | |
| 2019/0269212 | A1 * | 9/2019 | Swart | A45C 11/182 |

* cited by examiner

APPARATUS WITH SELF-RETRACTING ELASTOMERIC SUPPORT BAND

This application is a continuation-in-part of U.S. application Ser. No. 17/116,156, filed on Dec. 9, 2020, which is incorporated herein in its entirety.

1. FIELD OF THE INVENTION

This invention relates to an apparatus that is selectively attachable to the outer case of a cellular telephone ("cell phone") or other similarly portable device. The apparatus desirably includes a housing containing an elastomeric band, belt or strap that is principally disposed inside the housing when the apparatus is not in use. When the apparatus of the invention is attached to the outer case of a cell phone or other device, a portion of the elastomeric band, belt or strap can be selectively withdrawn from the housing and can be releasably latched or locked in place to form a flexible, continuous loop. The flexible continuous loop can be used, for example, to support the cell phone around a user's neck for hands-free use when the user is engaged in other activities. Alternatively, the flexible, continuous loop can be used as a selectively retractable carrying strap when the cell phone or other device is not in use. The apparatus may also include an integrated kickstand and card holder. The elastomeric band may wrap around the outer case to enable the case to hang selectively vertically, upright, or horizontally.

2. DESCRIPTION OF RELATED ART

Cell phones are most often carried in a hand, pocket, or bag of a mobile user. When the user is driving a motor vehicle, the cell phone is sometimes placed in a support frame or cradle mounted on or suspended from the dashboard, mirror, or console while the user utilizes a speaker phone or a "Bluetooth" connection to carry on a telephone conversation with another person. Unfortunately for the safety of a user and for other surrounding motorists, cell phones are more often held unsafely in one hand of a driver while grasping a steering wheel in the other hand.

Purses and shoulder bags comprising straps with buckles for adjusting strap length are also known and worn over the shoulder and/or around the neck of a user. More recently, purses and other small personal utility bags supported by conventional carrying straps have been disclosed and advertised that also comprise an outwardly facing pocket or compartment into which a cell phone can be inserted for convenient viewing through a transparent plastic "window."

Other prior devices commonly referred to as "measuring tapes" are made of housings containing a coiled strip of flexible metal with measuring indicia marked on it. Such devices typically comprise spring-powered retraction mechanisms that add weight, complexity, and expense to the products with which they are used and take up additional space without providing commensurate additional utility that are retractable into a housing following use.

It is also known that cell phone cases may include a kickstand that may be used to allow the phone to stand at an angle on a surface. For example, a person may want to watch video from the cell phone by releasing the kickstand to an open position that enables the phone to be propped on a flat surface.

There are other portable phone cases that have an area to store cards such as credit cards and driver licenses but do not have kickstands. However, these cases have cards secured on the outside the case creates a potential for someone to steal the cards from the outside of the case or the cards to fall out and be lost.

Additionally, known cases may hang vertically and sway back and forth making speaking into the microphone and/or reading the phone difficult. Moreover, the cases only provide a single hanging position.

However, there are no known portable cases that include a kickstand and a place for cards that are secured to prevent theft or lost. Moreover, there are no known cases that include an elastomeric band that can be wrapped around an apparatus in such a way to enable the portable phone to hang horizontally, vertically, right side up or upside down.

SUMMARY OF THE INVENTION

In one aspect, there is disclosed an apparatus that included a housing with a mutually engageable cover and a body, the body being selectively attachable to a cell phone or to a protective case or cover for a cell phone or another portable device; a flexible elastomeric band disposed inside the housing, the band being accessible through an opening in the housing and being and stretchable outwardly through an opening in the housing for a distance; an array of rotatable pulleys disposed in spaced-apart relation inside the housing, with each rotatable pulley having a periphery contacting and frictionally engaging the elastomeric band to support the elastomeric band in tension when a portion of the elastomeric band is stretched outwardly through the opening in the housing; a kickstand formed from at least a portion of the cover; and a card holder integrated on an inside portion of the kickstand.

The kickstand may be coupled to the body by a plurality of hinges. The elastomeric band includes a detachable portion. The kickstand may include a tab that is rotatably engageable with at least one of the plurality of hinges. The kickstand may form an angle relative to the body. One or more latches may secure the elastomeric band. The elastomeric band may be configured to enable the phone to hang one of vertically and horizontally when the elastomeric band is received in the one or more channels. The detachable portion may be formed from a material different from and having a thickness different that the elastomeric band. At least one of the front and rear covers of the housing is selectively attached to a cell phone or to a protective case for a cell phone by use of a pad treated with a pressure-sensitive adhesive that is applied to facing surfaces of the apparatus and one of the cell phone or protective case for a cell phone. The kickstand may include a first edge and a second edge. The first edge may contacts a surface to support the phone in a vertical position, and the second edge may contact a surface to support the phone in a horizontal position.

BRIEF DESCRIPTION OF THE DRAWINGS

The apparatus of the invention is further described and explained in relation to the following drawings wherein.

The reader should understand that like numbers are generally used to designate like parts in the accompanying drawing figures but that the figures are not drawn to scale.

DESCRIPTION OF THE PREFERRED EMBODIMENTS

Figure 1:
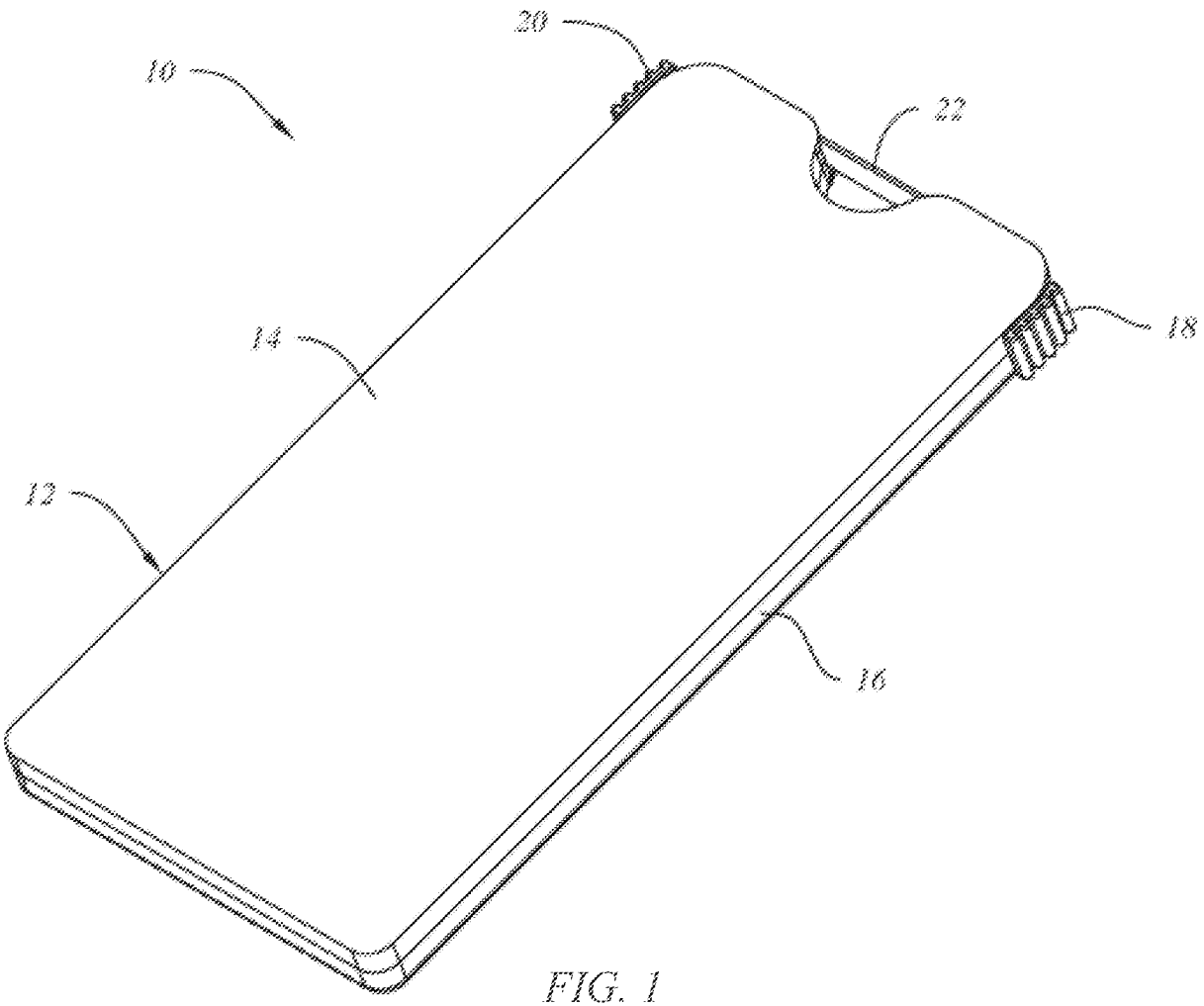
FIG. 1 is a rear perspective view of one embodiment of the apparatus of the invention with an elastomeric belt fully retracted into the housing except for a small portion that spans an opening in the housing and is manually accessible through the opening.
Figure 7:
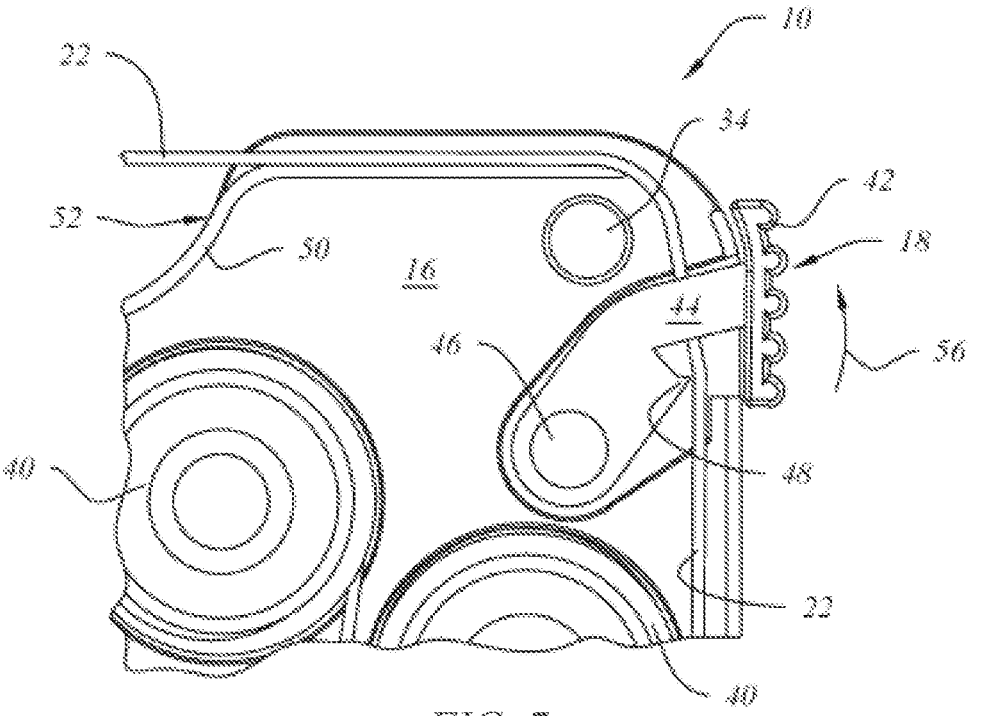
FIG. 7 is an enlarged detail rear elevation view of the apparatus of FIG. 1 shown substantially as in FIG. 8 with the rotatable latches rotated to an unlocked position to allow the elastomeric belt to contract inside the housing while still maintaining slight tension in an accessible portion of the elastic band that spans an opening in the housing to avoid having slack in the elastomeric belt when retracted.
Figure 8:
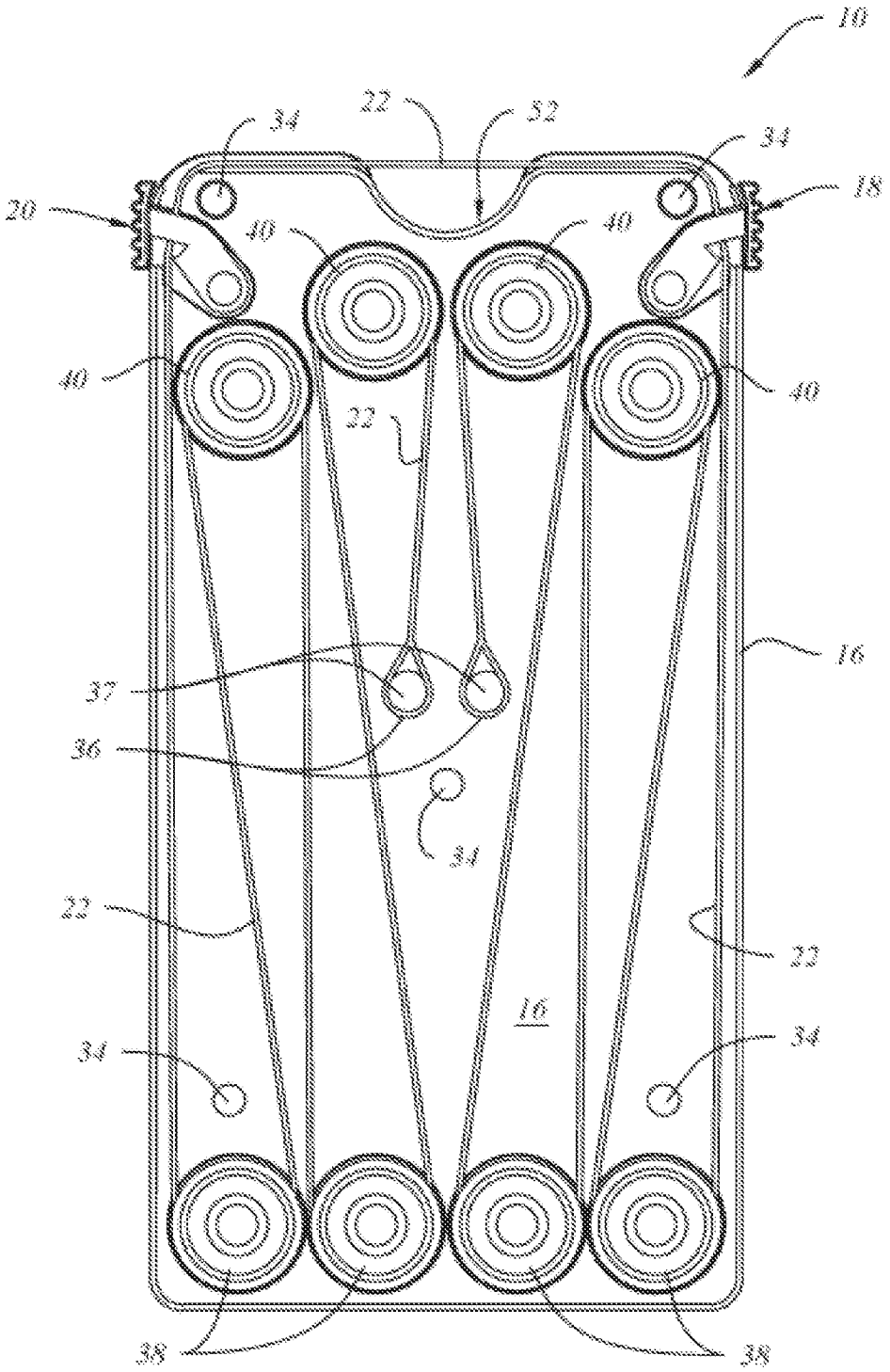
FIG. 8 is an enlarged detail rear elevation view of the apparatus of FIG. 1 with the rear cover of the housing removed and the rotatable latches positioned in an unlocked position to allow the elastic band to contract to the greatest extent permitted inside the housing while still maintaining slight tension in the portion of the elastic band disposed inside the housing to avoid having slack in the elastic band.

Referring to FIGS. 1, 7 and 8, apparatus 10 comprises housing 12 further comprising body 16 with selectively removable cover 14, opposing latches 18, 20 and an elastomeric band 22 disposed inside housing 12, with a portion of elastomeric band 22 being visible and graspable through recessed opening 52 cooperatively formed in cover 14 and body 16. Housing 12 of apparatus 10 is desirably formed from a moldable polymeric material such as, for example, high impact polystyrene or another similarly suitable material. Elastomeric band 22 is desirably disposed entirely inside housing 12 (except for the portion of elastomeric band 22 that is visible and graspable 12 when latches 18, 20 are in an unlocked position and elastomeric band 22 is relaxed sufficiently to self-retract into housing 12).

Figure 3:
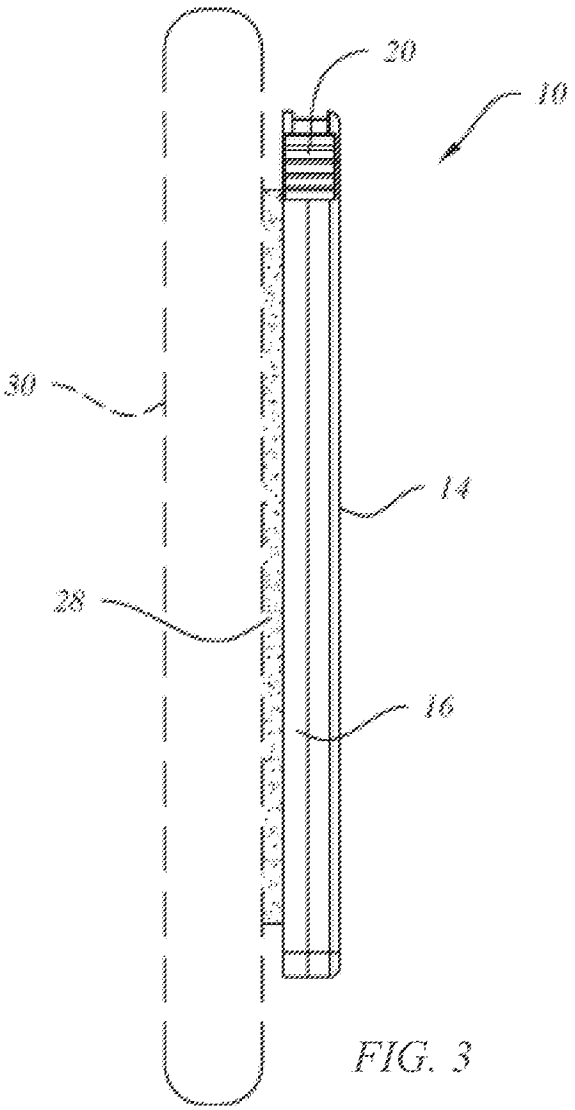
FIG. 3 is a right-side elevation view of the embodiment of FIG. 2 with the cover sheet of FIG. 2 removed from the adhesive pad and the adhesive pad adhered to the rearwardly facing surface of a cell phone shown in dashed outline.
Figure 2:
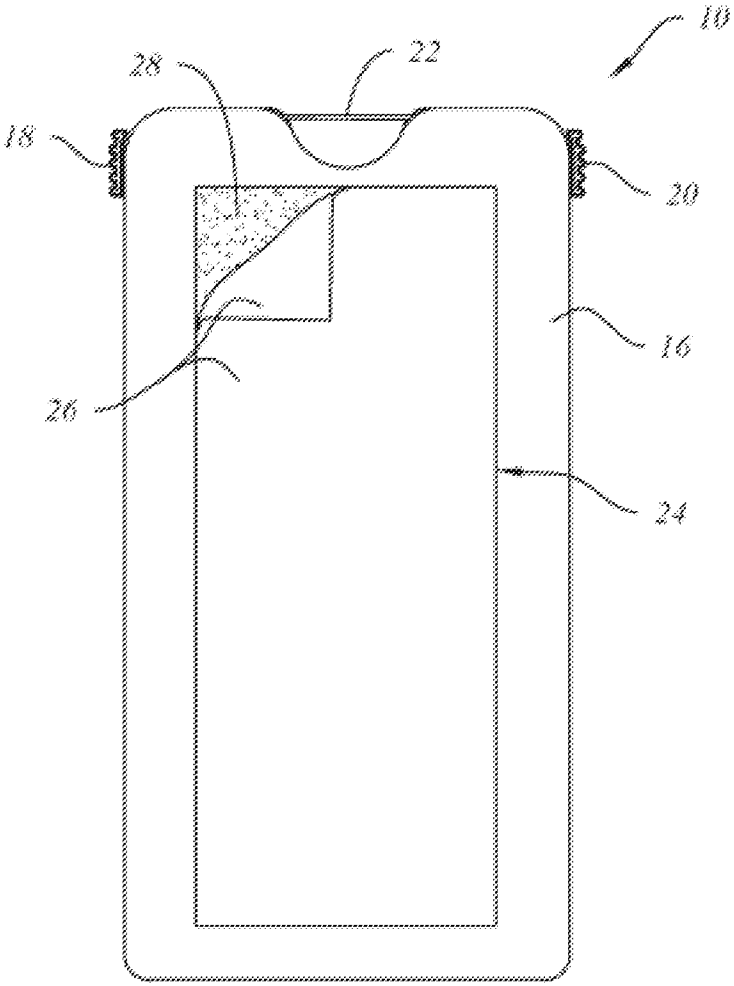
FIG. 2 is a front elevation view of the embodiment of the apparatus of FIG. 1 with a pressure-sensitive adhesive pad adhered to the front cover of the housing and having a peel-away cover sheet partially removed from the adhesive pad.

Referring to FIGS. 2 and 3, apparatus 10 is desirably attachable to a portable device such as a cellular telephone 30 (not part of the invention except when the other functional portions of apparatus 10 are incorporated into a body 14 that forms part of the portable device) using an adhesive pad 28 or other similarly effective attachment means permitting use of apparatus 10 as an aftermarket attachment to cellular telephone 30. Adhesive pad 28 of a size satisfactory for this purpose are typically commercially available and provided with a peel-off cover sheet 26 on each side that is removable to expose oppositely facing adhesive surfaces suitable for use in securing body 16 of housing 12 to the back surface of a device such as cellular telephone 20 with which it is intended to be used. When apparatus 10 is ready for use when configured as shown in FIG. 3, with latches 18 and 20 unlatched and elastomeric band 22 disposed in a visible and graspable position but is otherwise fully retracted inside housing 12 (FIG. 1).

Figure 4:
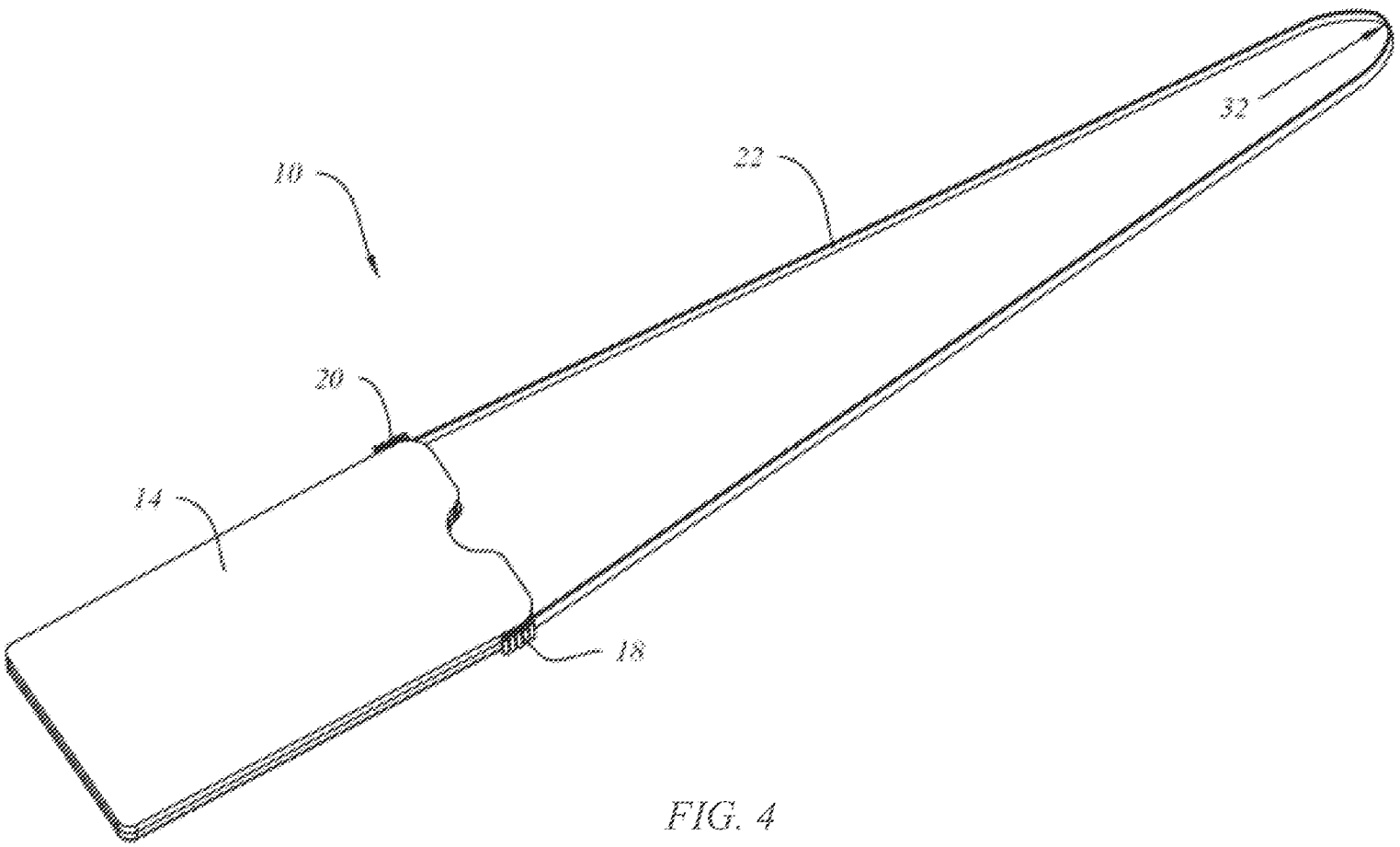
FIG. 4 is a rear perspective view of the apparatus as in FIG. 1 with the elastomeric belt extended outside the housing through an opening in the housing.

Referring to FIG. 4, apparatus 10 is shown with a portion of elastomeric band 22 pulled outwardly away from cover 14 to form a flexible elongated loop of desired size when a force 32 is exerted against the outermost portion of elastomeric band 22 relative to the other portions of apparatus 10. During the expansion of elastomeric band 22 as shown in FIG. 4, latches 18 and 20 are desirably positioned to permit outwardly directed movement of elastomeric band relative to cover 14. When elastomeric band 22 is stretched outwardly to a desired extent, latches 18 or 20 can be manually engaged by the user to prevent self-retraction of elastomeric band 22 back inside apparatus 10. Latches 18, 20 can be configured to be manually engageable and releasable or, alternatively, to automatically engage by rotating to create frictional contact between elastomeric band 22 and body 16 of apparatus 10 when force 32 (FIG. 4) is relaxed and elastic band is permitted to self-retract.

Figure 5:
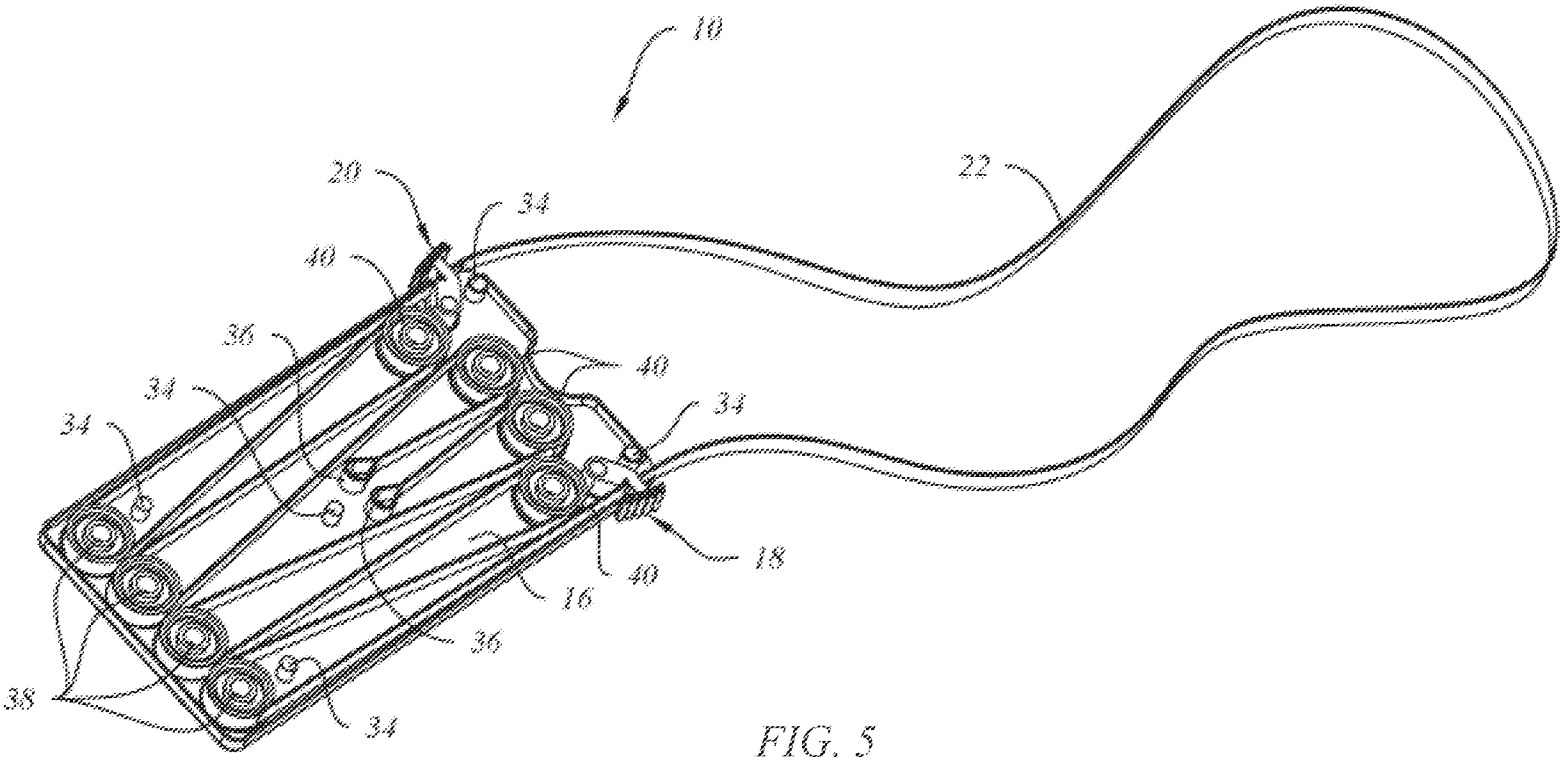
FIG. 5 is a rear perspective view as in FIG. 4 with the rear cover of the housing removed and rotatable latches positioned to hold the elastomeric belt in the fully extended position relative to the housing, thereby allowing the portion of the elastomeric belt extending outwardly from the housing to relax from the fully extended position.

Referring to FIGS. 5-8, apparatus 10 is depicted with cover 14 (FIG. 4) removed to reveal the inside of housing 12 (FIG. 1) as seen looking into body 16. Body 16 preferably further comprises a plurality of rotatable wheels or pulleys (hereafter "pulleys") 40 around which elastomeric band 22 is positioned for use. Referring to FIGS. 5 and 8, in this embodiment of the invention, each of two opposed ends of elastomeric band 22 comprises a loop 36 that is disposed over one of two spaced-apart anchor posts 37 and then wrapped circuitously around pulleys 40, with the centrally disposed portion of elastomeric band 22 passing between latches 18, 20 and inside wall of body 16, around guide wall 50 (best visible in FIGS. 6 and 7), and across recessed opening 52. A plurality of spaced-apart sites 34 are disposed inside body 16 that are desirably coaxially aligned with corresponding sites on the underside of cover 14 (FIG. 1) that cooperate provide structural support to body 16 and frictional engagement with the underside of cover 14 (FIG. 1). Sites 34 can be used to position posts that are frictionally engageable, for example, with opposed receptacles disposed under cover 14 to provide "snap-fit" frictional engagement between cover 14 and body 16. Alternatively, other selectively releasable attachment means such as screws and cooperatively aligned threaded receptacles can be used to attach cover 14 to body 16 of apparatus 10. Additionally, in another alternative embodiment of the invention described but not depicted in relation to FIG. 8, a plurality of spacers (preferably wedge-shaped guides) can be provided in the triangularly shaped spaces formed between the two oppositely disposed sets of pulleys 40 inside body 16 to avoid tangling of portions of elastomeric band 22 inside housing 12 (FIG. 1) during a sudden release and relaxation of elastomeric band 22 from the position shown in FIG. 5 to the position shown in FIG. 8.

Figure 6:
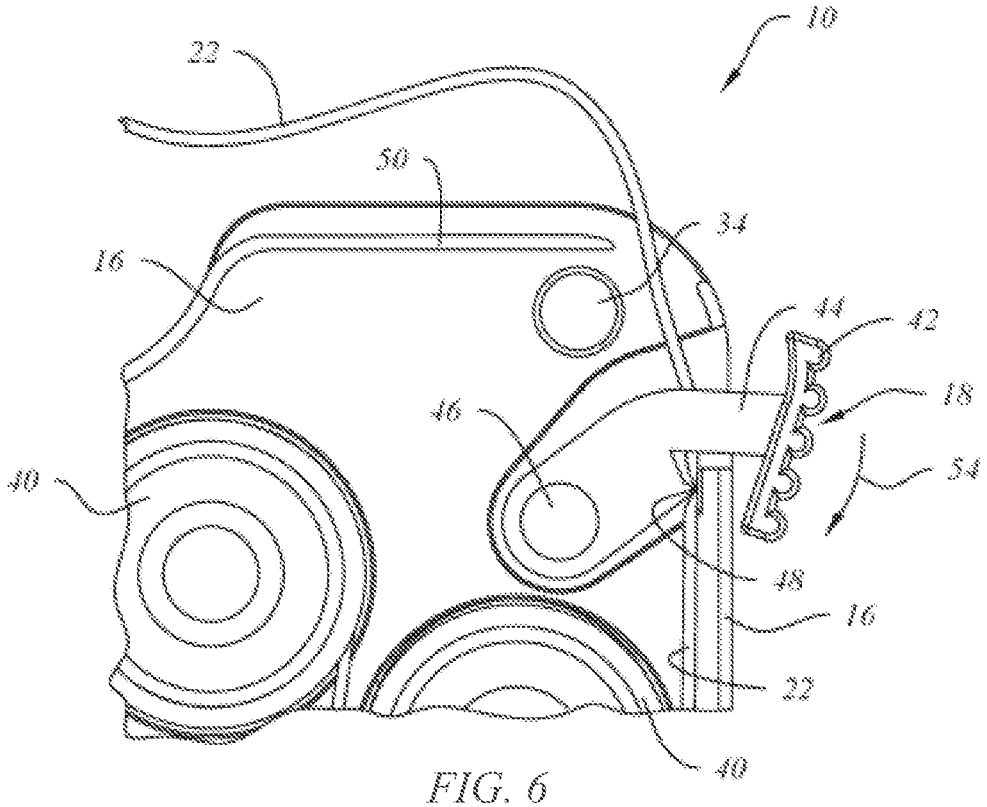
FIG. 6 is an enlarged detail rear elevation view of the apparatus of FIG. 1 shown substantially as in FIG. 5 with the rear cover of the housing removed and the rotatable latches rotated to a locked positioned to hold the portion of the elastomeric belt disposed inside the housing in an extended position and under tension inside the housing while allowing a portion of the elastomeric belt disposed outside the housing to remain in a comparatively more relaxed position that is not under tension outwardly of the latches.

Referring to FIGS. 6-8, rotatable latches 18, 20 are desirably used to provide selectively releasable frictional engagement between elastomeric band 22 and inside wall of body 16. Referring to FIG. 6, latch 18 with touch surface 42, lever arm 44 and pivot post 46 is shown in a "latched" position with lateral projection 48 "pinching" a portion of elastomeric band 22 against body 16 after rotating latch 18 downwardly by the application of manual pressure to touch surface 42 of latch 18 as indicated by arrow 54. Conversely, referring to FIG. 7, latch 18 is shown in an "unlatched position" with lateral projection 48 rotated upwardly as indicated by arrow 56 to release the adjacent portion of elastomeric band 22 from frictional engagement with body 16 to thereby permit self-retraction of elastomeric band 22 back inside housing 12 as shown in FIG. 1.

Figure 9A:
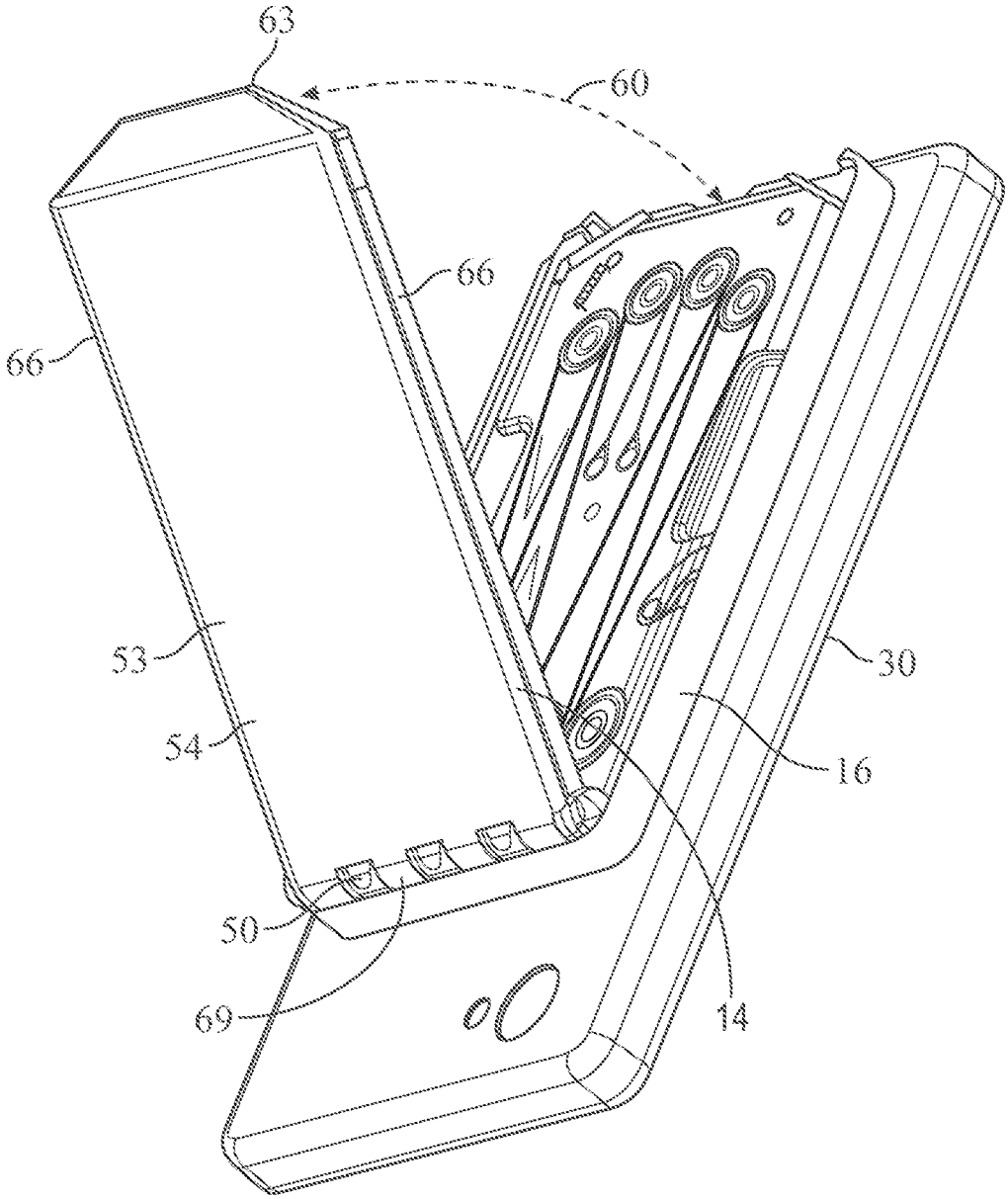
FIG. 9A shows an embodiment of an apparatus including a kickstand with an integrated card holder.

FIG. 9A shows the apparatus 10 and cover 14 including a kickstand 53 attached to the body 16 in an embodiment. The kickstand 53 may be part of cover 14 or may form the entire cover 14. The kickstand 53 may be coupled to the body 16 by one or more hinges 50 that are rotatably coupled to the body 16. In other embodiments, the kickstand 53 may be molded to the body 16. In yet other embodiments, the kickstand 53 may rotate around hinges 50 at an angle 60.

Figure 9B:
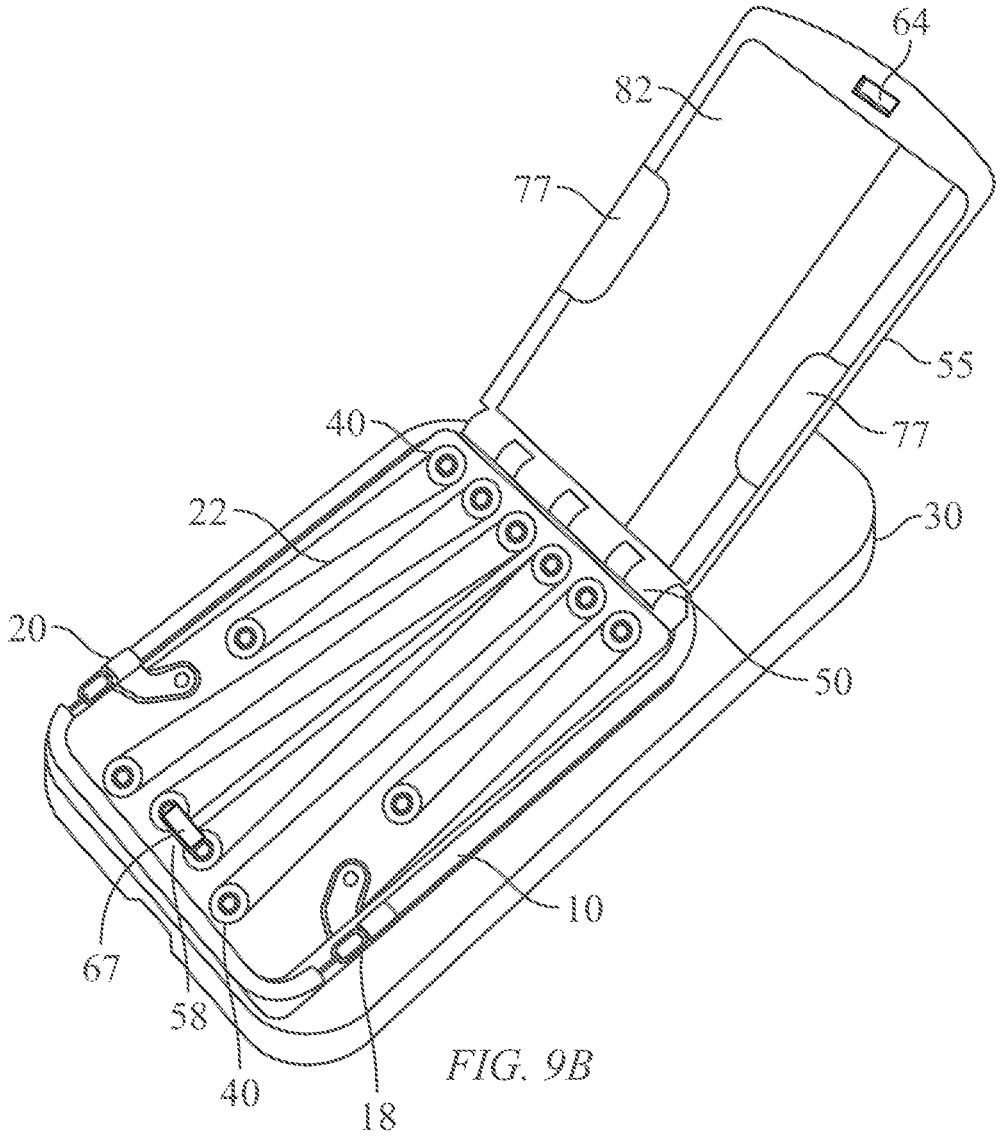
FIG. 9B shows an embodiment of an apparatus including a kickstand with an integrated card holder.

The kickstand 53 may include a top side 54 and a bottom side 55 (FIG. 9B). The kickstand 53 may include an edge 63 to engage a surface to position the mobile phone 30 at an angle 60 vertically. The kickstand 53 may include one or more edges 66 that engage a surface to position the mobile phone 30 horizontally.

As shown in FIG. 9A, the kickstand 53 may extend between a closed position and an open position so the mobile phone 30 is propped at an angle relative to a surface at an angle 60. The angle 60 may be between substantially zero and substantially 135 degrees. The kickstand 53 may rest on edge 63 to position the portable device angled vertically or on edge 66 to position the portable device angled horizontally relative to the surface. The kickstand 53 may be made from plastic, metal, or other hard material that may be shaped in the form of the kickstand 53. In some embodiments, between the hinges 50 may be formed a groove 69 that frictionally engages the hinge 50 to provide support to the kickstand 53.

As shown in FIG. 9B, in a locked or closed position, the kickstand 53 may be secured at end 58 of the apparatus 10. In one embodiment, the kickstand 53 may include a locking tab 64 that may engage a locking member 67 at end 58 of bottom side 55 of the kickstand 53. In one embodiment, the locking tab 64 may be a slit that snaps into locking member 67. In other embodiments, the locking member 67 may be coupled to the locking tab 64 by Velcro, buttons, or magnets.

Figure 10A:
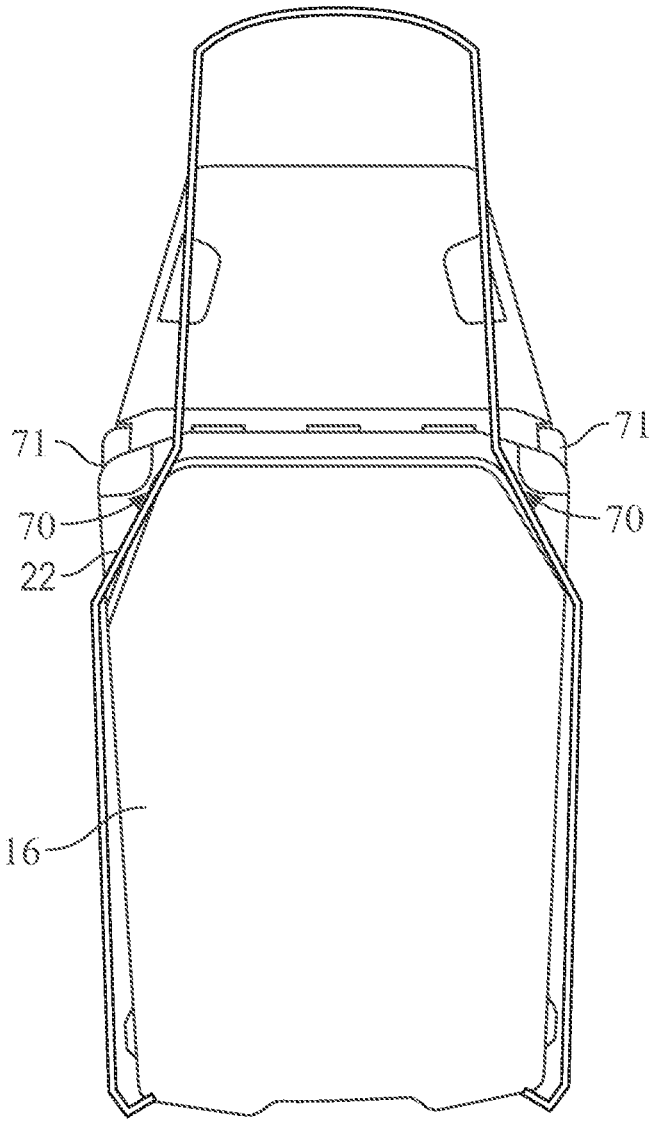
FIG. 10A shows an embodiment showing an elastomeric band configured with an apparatus.
Figure 10B:
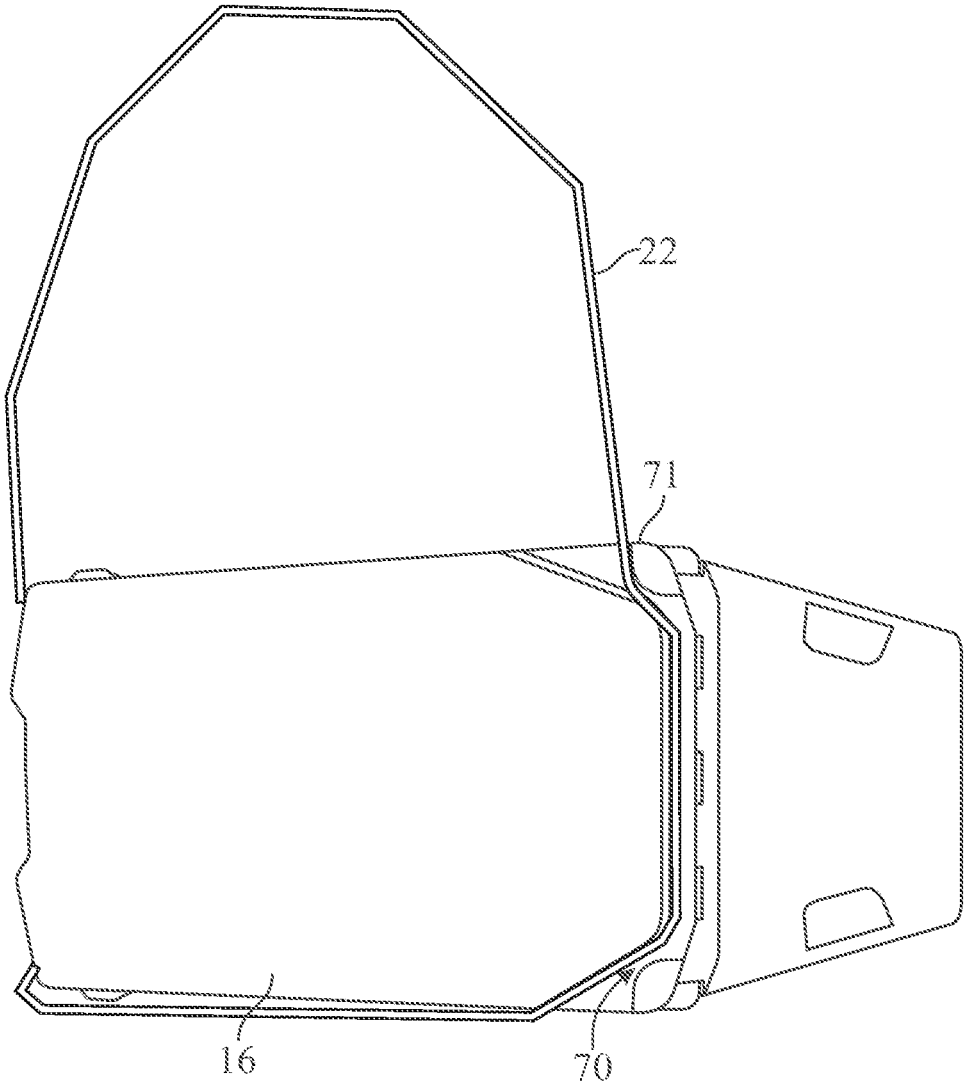
FIG. 10B shows an embodiment showing an elastomeric band configured with an apparatus.
Figure 10C:
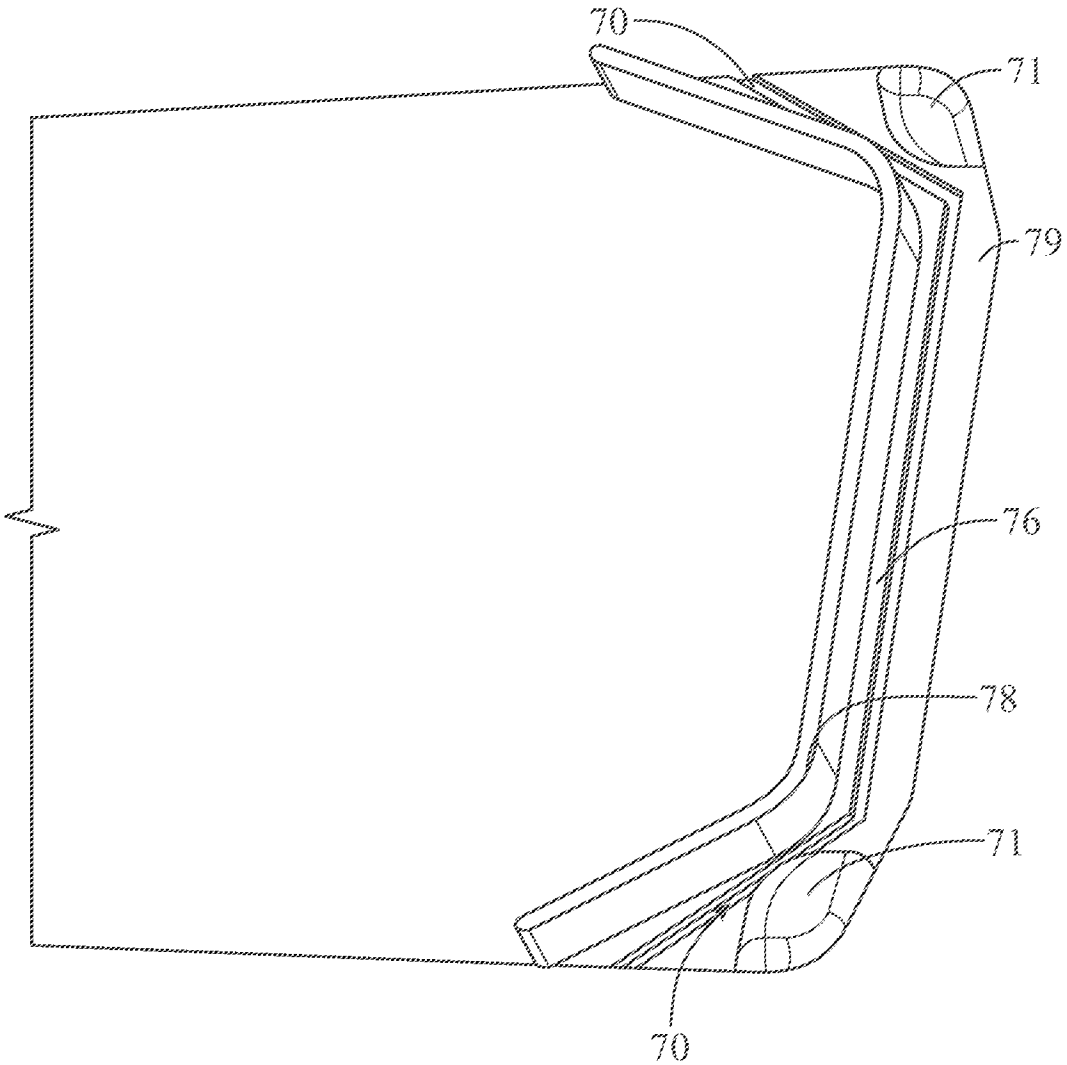
FIG. 10C shows an embodiment showing an elastomeric band configured with an apparatus.

FIGS. 10A-10C show a view of the body 16 with one or more channels 70. The channel 70 may be formed between a bump 71 and a lower body 78 an angle. The channel 70 may be substantially identical at each point or different at each point. The channel 70 may be of a size and shape to secure the elastomeric band 22 between the bump 71 and lower body 78. The elastomeric band 22 may be secured into and removed from the channel by pushing the elastomeric band 22 into and out of the channel 70. A channel 76 may also be formed between an upper wall 79 and lower body 78 at an angle. The channel 76 may be configured to receive the elastomeric band 22.

As shown in FIG. 9B, the kickstand 53 may also include one or more fingers 77 formed into or integrated into the body kickstand 53 to form a single unit to slidably secure a card 82, such as a credit card, driver's license, dollar bills, or the like. The fingers 77 may be formed from plastic, metal, or other material that is hard and flexible. In other embodiments, a sleeve may be integrated into kickstand 53 form a single unit of material. A sleeve may be stitched or molded into the kickstand 53. The sleeve may be configured to be of a size and shape to receive and/or secure a card, such as a credit card, license, and the like. FIG. 9B shows that the apparatus 10 may include twelve pulleys 40 that does not require loops 36 or anchor posts 37 to support band 22.

The elastomeric band 22 may pass through the channel 70 and the opening 76 to enable the phone 30 to vertically or upright (FIG. 10A) or horizontally or sideways (FIG. 10B).

In some embodiments, the bump 71 may have a wall with an angled edge 78 as shown in FIG. 10B to enable the elastomeric band 22 to be slid into the channel 70 more easily. In one embodiment, the channel 70 is narrower that than the channel 76 and the elastomeric band is secured in the channel 70 by being pinched between the bump 71 and wall 78 on each side of the cover 14.

Figure 11:
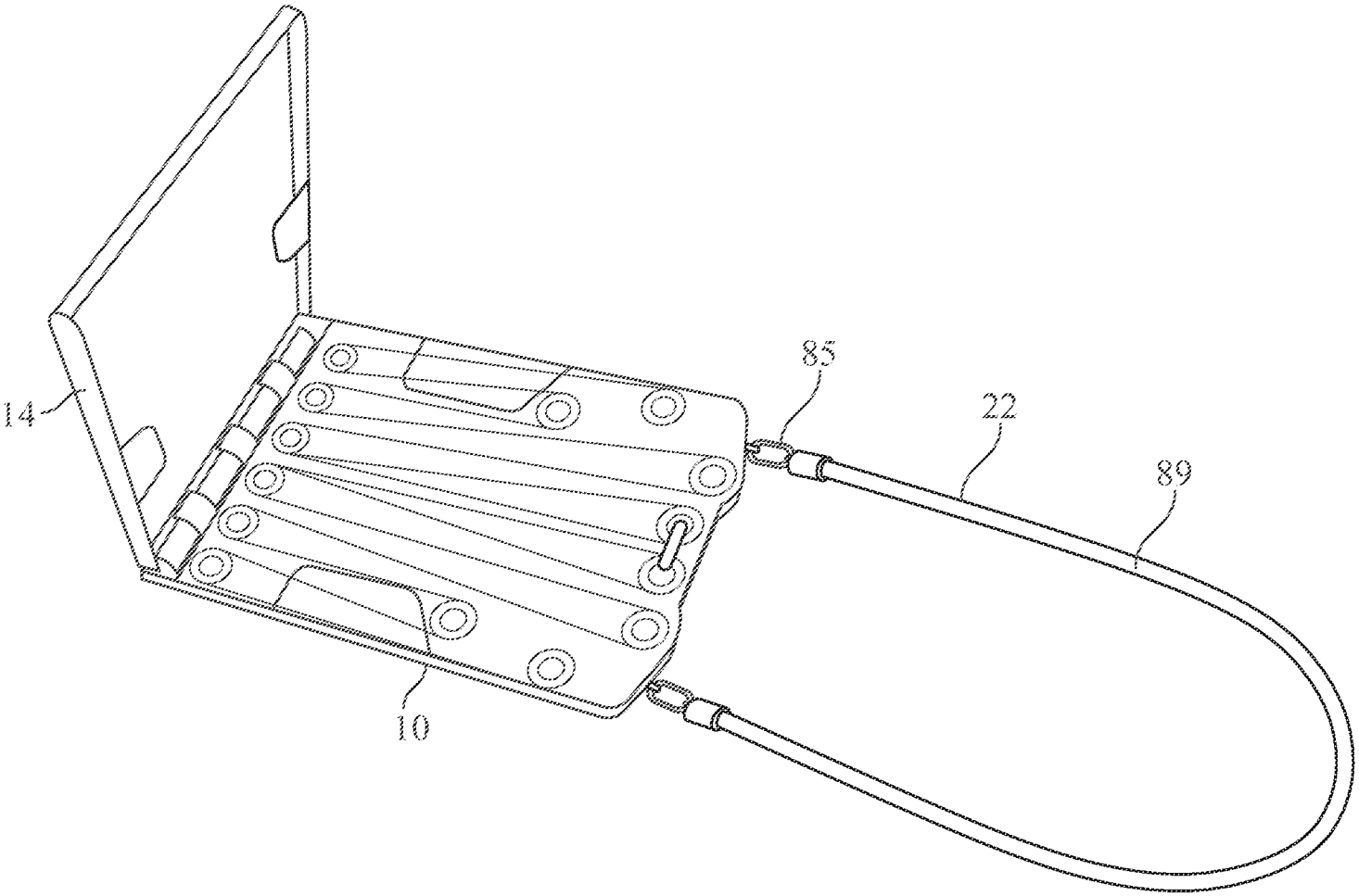
FIG. 11 shows an embodiment showing an elastomeric band in an embodiment.

As shown in FIG. 11, in some embodiments, the elastomeric band 22 may include a detachable portion 89. The detachable portion 89 may include a detachable ring 85. The embodiment of FIG. 11 may provide stability and limited movement to the phone 30 when it is hanging horizontally or vertically around a person's neck. The detachable portion 89 may also be formed to be thicker or thinner and a different material that elastomeric band 22 to provide additional comfort.

Figure 12A:
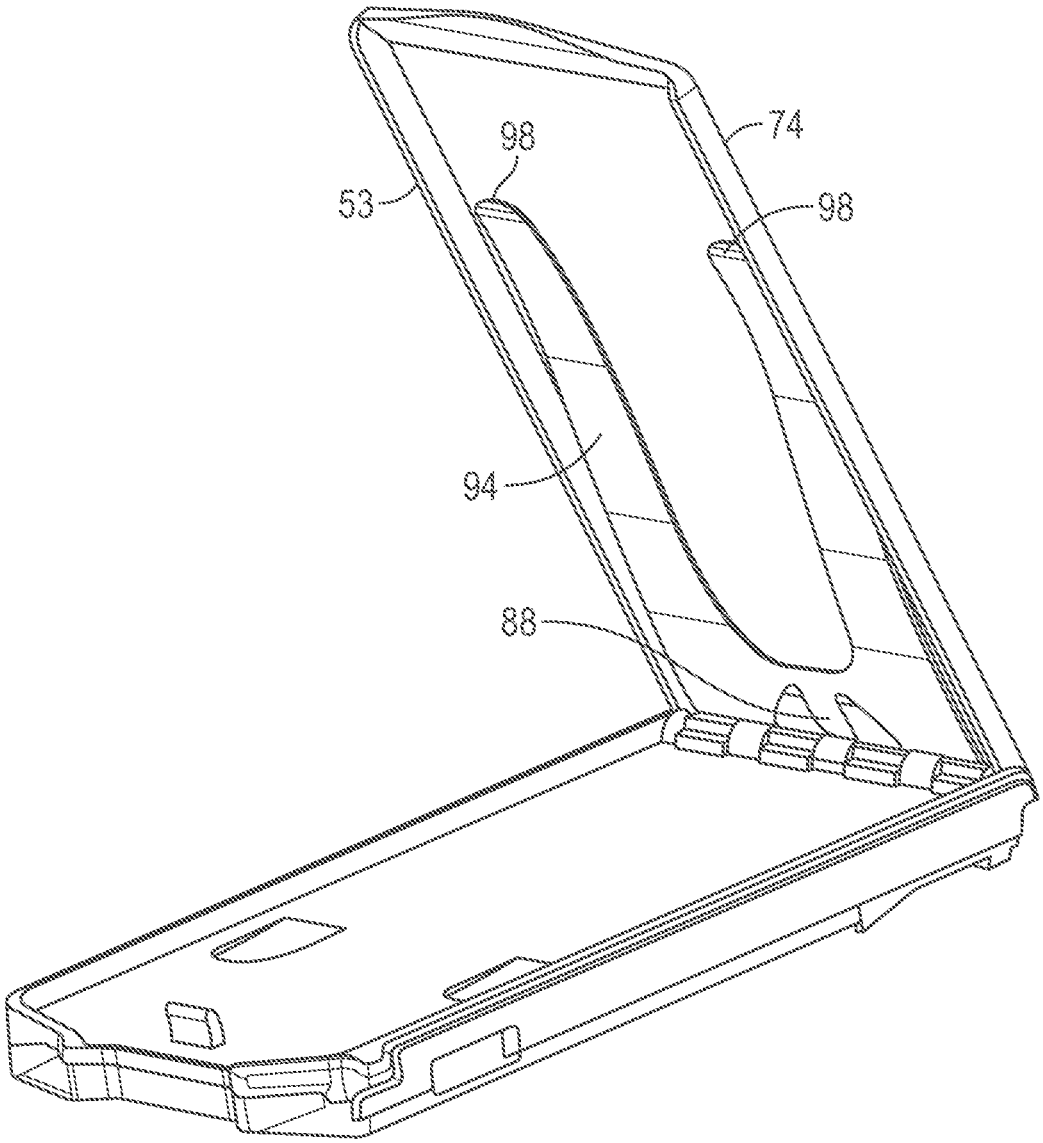
FIG. 12A shows an embodiment showing an apparatus including a kickstand with an integrated card holder.
Figure 12B:
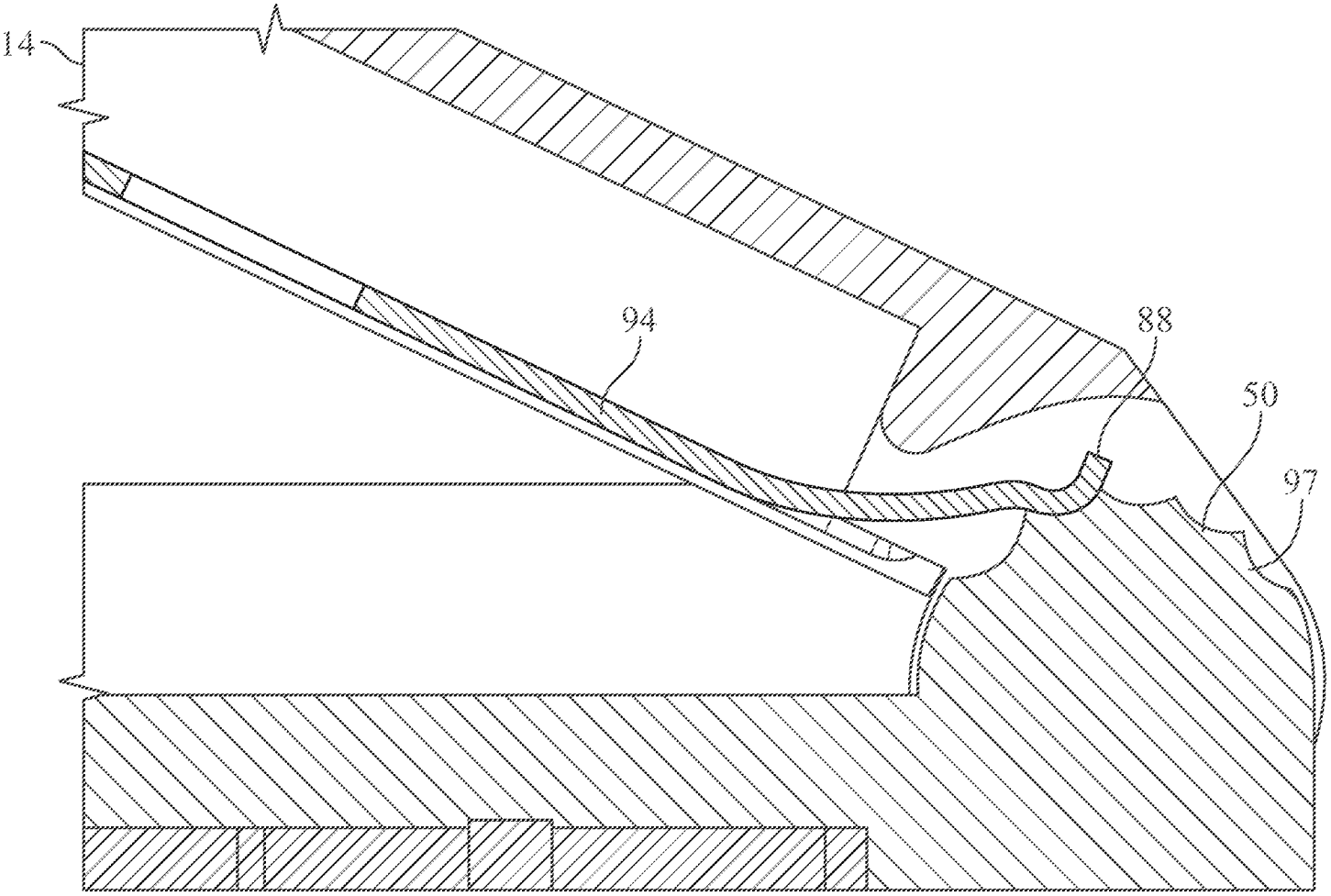
FIG. 12B an apparatus including a kickstand with an integrated card holder.

FIGS. 12A and 12B shows an embodiment of a clip 94 that may be formed into the kickstand 53 on bottom side 55. The clip 94 may include one or more fingers 98 configured to slidably receive a card, such as a credit card, license, and the like and secure the card when the clip 94 may include a tab 88 that is designed to rotatably engage grooves 97 in hinge 50 when the kickstand moves between open and closed positions.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor and/or Applicant are legally entitled.

What is claimed is:

1. An apparatus, comprising:

a housing with a mutually engageable cover and a body, the body being selectively attachable to a cell phone or to a protective case or cover for a cell phone or another portable device;

a flexible elastomeric band disposed inside the housing, the band being accessible through an opening in the housing and being stretchable outwardly through an opening in the housing for a distance;

an array of rotatable pulleys disposed in spaced-apart relation inside the housing, with each rotatable pulley having a periphery contacting and frictionally engaging the elastomeric band to support the elastomeric band in tension when a portion of the elastomeric band is stretched outwardly through the opening in the housing;

a plurality of triangularly shaped spaces that are formed between two oppositely disposed sets of pulleys inside the body;

a kickstand formed from at least a portion of the cover; and a card holder integrated on an inside portion of the kickstand.

2. The apparatus of claim 1 wherein the kickstand is coupled to the body by a plurality of hinges.

3. The apparatus of claim 1 wherein the elastomeric band includes a detachable portion.

4. The apparatus of claim 1, wherein the kickstand includes a tab that is rotatably engageable with at least one of a plurality of hinges.

5. The apparatus of claim 1, wherein the kickstand forms an angle relative to the body.

6. The apparatus of claim 1 further comprising one or more latches to secure the elastomeric band.

7. The apparatus of claim 1, wherein a top side of the cover includes one or more channels to receive the elastomeric band.

8. The apparatus of claim 1, wherein the one or more channels is formed at an angle.

9. The apparatus of claim 1, wherein the elastomeric band is configured to enable the phone to hang one of vertically and horizontally when the elastomeric band is received in the one or more channels.

10. The apparatus of claim 3, wherein the detachable portion is formed from a material different from and having a thickness different than the elastomeric band.

11. The apparatus of claim 1 wherein the cover and body of the housing are frictionally engageable.

12. The apparatus of claim 1 wherein at least one of the front and rear covers of the housing is selectively attached to a cell phone or to a protective case for a cell phone by use of a pad treated with a pressure-sensitive adhesive that is applied to facing surfaces of the apparatus and one of the cell phone or protective case for a cell phone.

13. The apparatus of claim 1 wherein the housing and pulleys comprise a moldable polymeric material.

14. The apparatus of claim 1, wherein the kickstand includes a clip.

15. The apparatus of claim 14, wherein the kickstand includes a first edge that contacts a surface to support the phone in a vertical position.

16. The apparatus of claim 14, wherein the kickstand includes a second edge that contacts a surface to support the phone in a horizontal position.

17. The apparatus of claim 1 further comprising a clip.

18. The apparatus of claim 1, wherein the number of pulleys is at least eight.

19. The apparatus of claim 1, wherein the portable device is a cell phone.

20. The apparatus of claim 1, wherein the at least one selectively releasable latch is manually engageable and releasable.

21. The apparatus of claim 1, wherein the at least one selectively releasable latch is automatically engaged by rotating to create frictional contact between the elastomeric band and body when a force is relaxed and elastomeric band is permitted to self-retract.

22. The apparatus of claim 1, wherein a plurality of spacers are provided in the plurality of triangularly shaped spaces.

23. The apparatus of claim 1, where the cover is releasably attached to the body.

24. The apparatus of claim 13, wherein the spacers are wedged-shaped guides.

* * * * *